US010625290B2

(12) United States Patent
Brown

(10) Patent No.: US 10,625,290 B2
(45) Date of Patent: Apr. 21, 2020

(54) PROTECTIVE PAINTING SHIELD FOR CIRCULAR FIXTURE JUNCTIONS

(71) Applicant: Kenneth Brown, Morrisville, PA (US)

(72) Inventor: Kenneth Brown, Morrisville, PA (US)

( * ) Notice: Subject to any disclaimer, the term of this patent is extended or adjusted under 35 U.S.C. 154(b) by 419 days.

(21) Appl. No.: 15/260,119

(22) Filed: Sep. 8, 2016

(65) Prior Publication Data

US 2017/0066007 A1 Mar. 9, 2017

Related U.S. Application Data

(60) Provisional application No. 62/215,703, filed on Sep. 8, 2015.

(51) Int. Cl.

| | |
|---|---|
| ***B05C 21/00*** | (2006.01) |
| ***B05B 12/20*** | (2018.01) |
| ***B05B 12/24*** | (2018.01) |

(52) U.S. Cl.

CPC ..... *B05B 12/29* (2018.02); *B05B 12/24* (2018.02); *B05C 21/005* (2013.01)

(58) Field of Classification Search

None

See application file for complete search history.

(56) References Cited

U.S. PATENT DOCUMENTS

| | | | | |
|---|---|---|---|---|
| 4,327,663 | A * | 5/1982 | Izzo | B05B 15/045 118/505 |
| 4,443,283 | A * | 4/1984 | Sarkisian | B05B 15/0456 156/211 |
| 4,921,028 | A * | 5/1990 | Schwartz | B05B 15/0456 118/505 |
| 7,022,187 | B2 | 4/2006 | Stockton | |
| 7,077,909 | B1 * | 7/2006 | Crane | B05B 15/0456 118/500 |
| 7,121,696 | B2 | 10/2006 | Whitfield, Sr. | |
| 8,734,106 | B2 | 5/2014 | May et al. | |

* cited by examiner

*Primary Examiner* — Jethro M. Pence

(74) *Attorney, Agent, or Firm* — LaMorte & Associates, P.C.

(57) ABSTRACT

A protective collar for temporarily protecting an item from paint on a surface that is being painted. The protective collar is formed as a band having a convex surface and a concave surface. The band has a uniform thickness between the convex surface and the concave surface in the primary areas that are not tapered. The band embodies a spring bias that biases the band into a circular configuration. The first end and the second end of the band are tapered. Additionally, the band is tapered along its length adjacent a first long edge. This causes the first long edge to be thinner than the opposite second long edge. The tapered regions minimize the footprint of the spring collar on a surface.

9 Claims, 8 Drawing Sheets

PROTECTIVE PAINTING SHIELD FOR CIRCULAR FIXTURE JUNCTIONS

RELATED APPLICATIONS

The Applications claims the benefit of Provisional Patent Application No. 62/215,703, filed Sep. 8, 2015.

BACKGROUND OF THE INVENTION

1. Field of the Invention

In general, the present invention relates to paint shields that are used to protect recessed lighting pots, ceiling fans, chandelier bases, and other circular fixture junctions. More particularly, the present invention is related to reusable paint shields that wrap around the periphery of the object being painted.

2. Prior Art Description

When painting a ceiling, wall, door, or the like, painters must first prepare the surface for painting. This typically includes taping around the various hardware and fixtures that may be present on that surface. On a wall, power receptacles and moldings must be protected. On a door, the hinges and door knob must be protected. On a ceiling, it is typically lighting fixtures, such as the pots of recessed lighting, the bases of ceiling fans, and the bases of hanging chandeliers that must be protected. Furthermore, hanging elements, such as ceiling fans and chandeliers must be covered so they are not harmed by dripping paint while the ceiling is being painted.

Painters spend a lot of time and labor preparing a surface before painting. This is especially true when preparing a ceiling for painting. Due to the height of most ceilings, the preparation requires extensive ladder manipulation and a steady hand when applying protective tape around ceiling fixtures. Sloppy positioning of the tape results in uneven paint lines and/or paint contamination on the ceiling fixture. As such, a painter must spend a large amount of time and labor preparing to paint. This, in turn, makes the painting job, longer, more difficult, and more expensive.

The prior art is replete with various barriers that can be placed over wall receptacles or recessed lighting fixtures. Such prior art is exemplified by U.S. Pat. No. 7,121,696 to Whitfield, U.S. Pat. No. 7,022,187 to Stockton, and U.S. Pat. No. 8,734,106 to May. The problem associated with such prior art paint shields is that the shields are placed over the top of the fixture. As such, a shield must be selected or trimmed to be the same size as the fixture. The use of the shield also requires that the fixture be inset. Such prior art shields cannot be used on any fixture that protrudes from a surface, such as a hanging light or a ceiling fan. Any fixture that protrudes is left for a painter to manually tape.

A need therefore exists for a device and method that reduces the labor and time needed to prepare surfaces for painting. A need also exists for a device and method that simplifies the application of paint shielding around protruding fixtures, such as hanging lights and ceiling fans. These needs are met by the present invention as described and claimed below.

SUMMARY OF THE INVENTION

The present invention is a protective collar for temporarily protecting an item from paint on a surface that is being painted. The protective collar is formed as a band having a convex surface and a concave surface. The convex surface and the concave surface both share a first long edge and a parallel second long edge as these surfaces extend between a first end to an opposite second end. The band has a uniform thickness between the convex surface and the concave surface in the primary areas that are not tapered.

The band embodies a spring bias that biases the band into a circular configuration. In the circular configuration, the first end and the second end of the band overlap in an overlap region. Within the overlap region, the first end of the band and the second end of the band are tapered. In this manner, the combined thickness of the first end and the second end in the overlap region is no more than twenty five percent thicker than the uniform primary thickness of the band.

Additionally, the band is tapered along its length adjacent the first long edge. This causes the first long edge to be thinner than the opposite second long edge. The tapered regions minimize the footprint of the spring collar on a surface. This minimizes the areas on the painted surface that are inadvertently protected from paint.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention paint shield device can be embodied in many ways, only a few exemplary embodiments have been selected for illustration and discussion. The illustrated embodiments, however, are merely exemplary and should not be considered a limitation when interpreting the scope of the appended claims.

Figure 1:
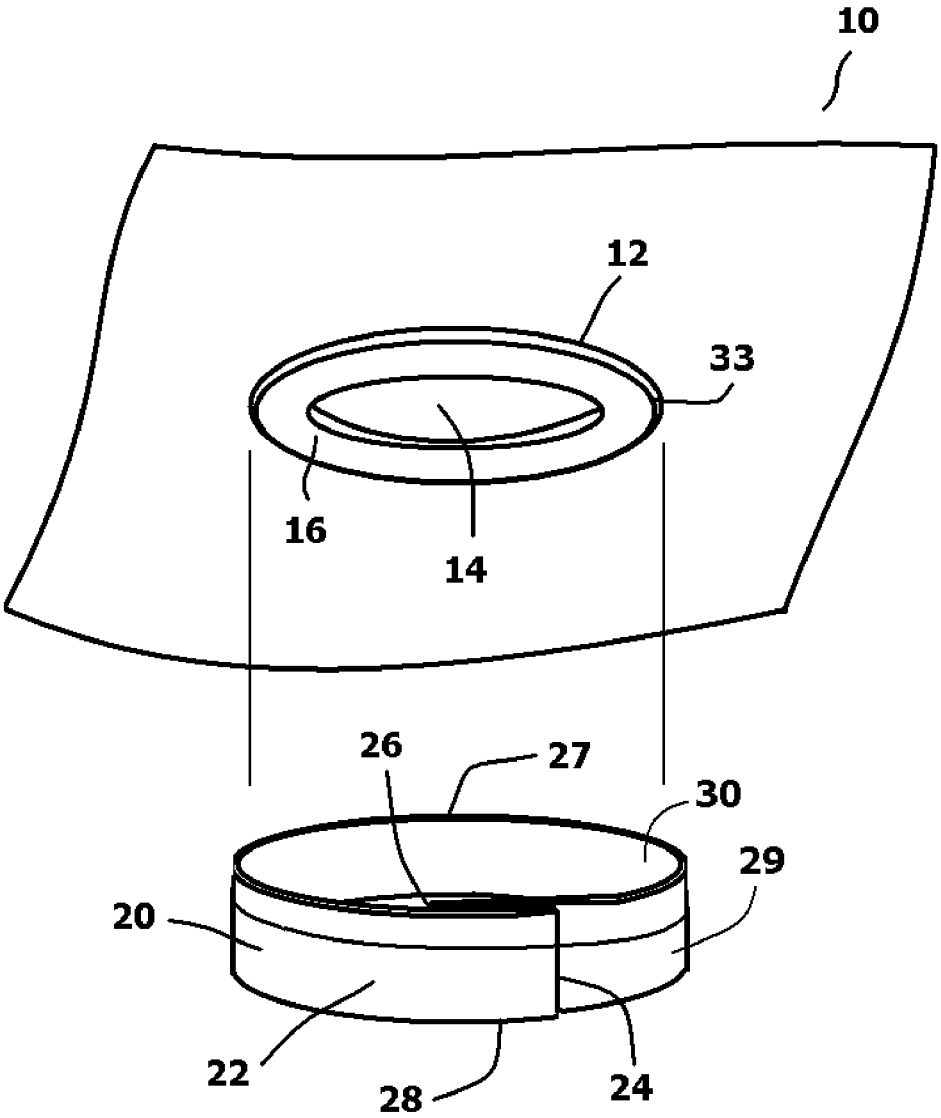
FIG. 1 is a perspective view of an exemplary embodiment of spring collar paint shield shown with a segment of a ceiling containing a recessed lighting unit.
Figure 2:
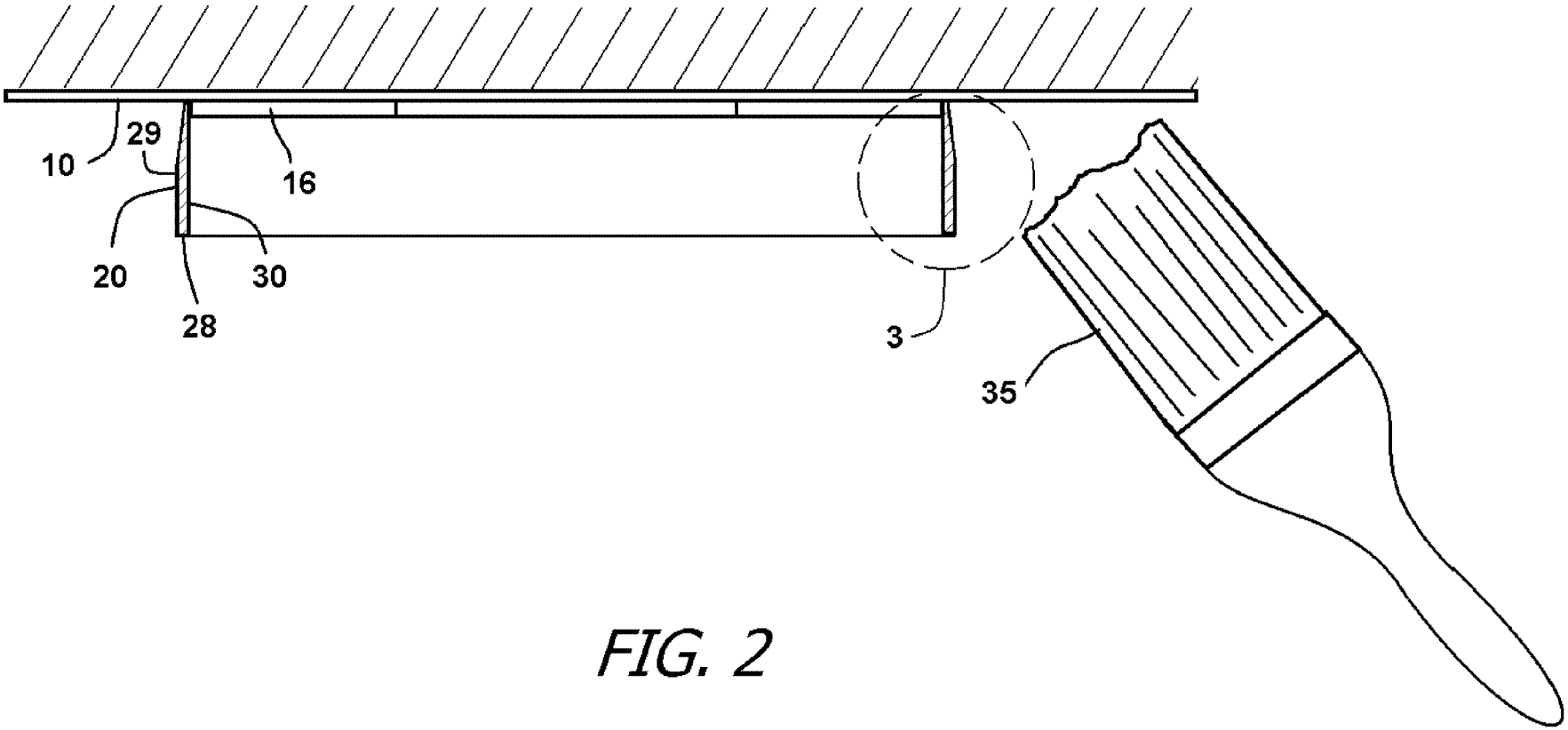
FIG. 2 shows a cross-section of the spring collar paint shield applied to the recessed lighting unit of FIG. 1.
Figure 3:
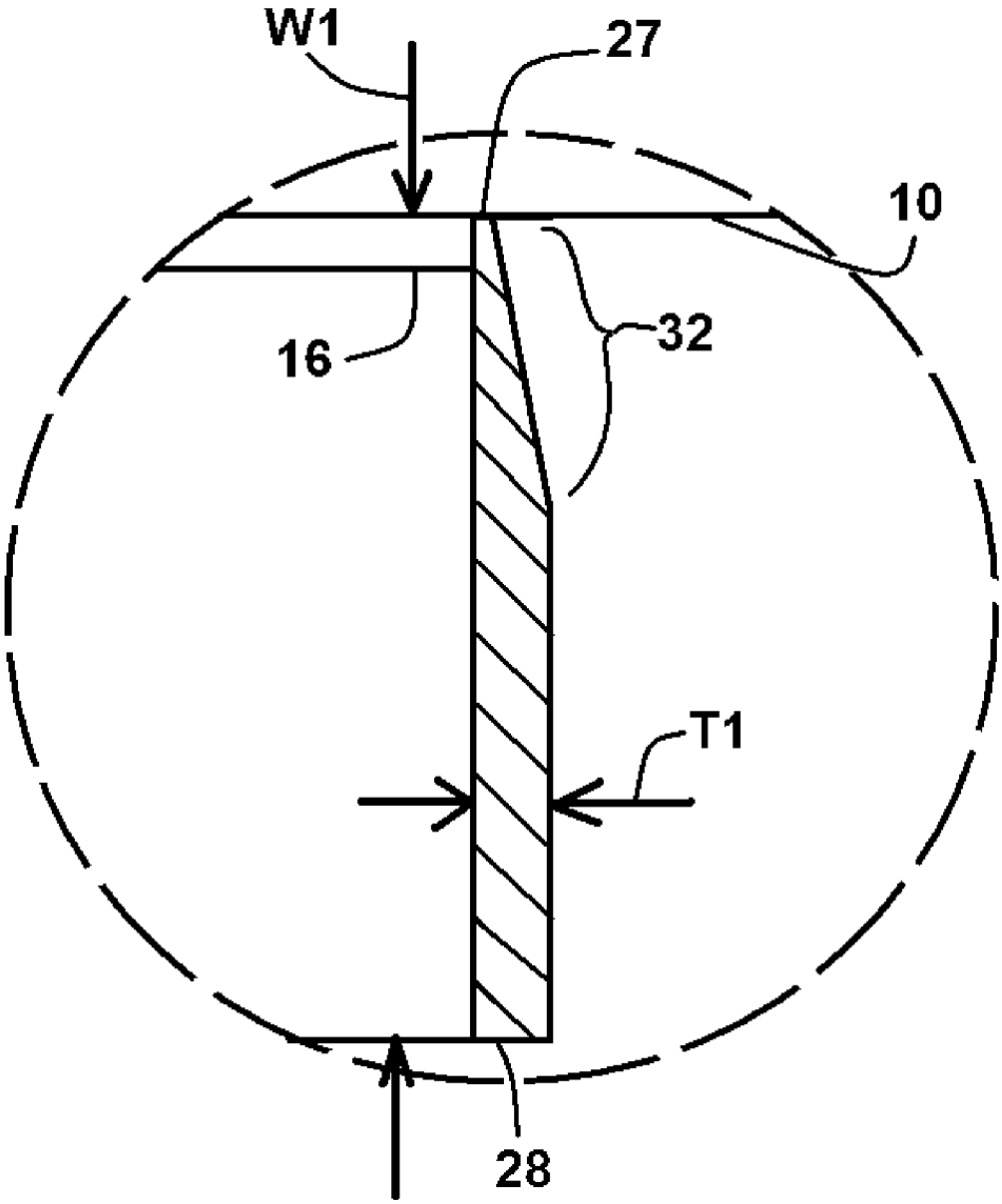
FIG. 3 is an enlarged view of the area contained within circle 3 of FIG. 2.

Referring to FIG. 1 in conjunction with both FIG. 2 and FIG. 3, a segment of a ceiling 10 is shown that contains a ceiling fixture 12. In the shown embodiment, the ceiling fixture 12 is a recessed lighting unit 14, commonly referred to as "a pot" in the lighting industry. The recessed lighting unit 14 has an aesthetic cover 16 that extends over part of the ceiling 10 around the recessed lighting unit 14. Depending upon the size of the recessed lighting unit 14, the aesthetic cover 16 typically has a diameter of between four inches and eight inches. The aesthetic cover 16 is typically manufactured in a color and is not painted. As such, the covers 16 must be protected when the ceiling 10 is to be painted.

The present invention is a protective spring collar 20. The spring collar 20 is shaped as a band 22 having a first end 24 and an opposite second end 26 that are separated by a length of between ten inches and twenty-five inches. The band 22 has a first long edge 27 and a parallel second long edge 28 that are separated by a width W1 along the length of the band 22. The width W1 is between one inch and three inches. The band 22 also has a primary thickness T1 of no greater than $1/16^{th}$ of an inch in all areas that are not otherwise indicated as being tapered. Additionally, the band 22 has a spring bias that coils the band 22 into a circular configuration where the first end 24 and the second end 26 of the band 22 overlap. Due to the circular shape created by the spring bias, the spring collar 20 has an exterior convex surface 29 and an interior concave surface 30. The primary thickness T1 of the spring collar 20 exists between the exterior convex surface 29 and the interior concave surface 30 in all areas not otherwise identified as being tapered. In this manner, if the band 22 is held straight and released, the band 22 will coil and overlap near the first end 24 and the second end 26 to form a circle.

The spring collar 20 can contain a metal coil spring. However, the spring collar 20 is preferably cut from a thick sheet of plastic or can be molded from plastic. The preferred plastic is a polypropylene plastic. This is because latex paint does not bond well to polypropylene. Accordingly, any paint that is deposited onto the spring collar 20 can be easily washed away, if wet, or peeled away after the paint has dried.

The thickness T1 of the spring collar 20 can be uniform between the first long edge 27 and the second long edge 28. However, this is not preferred. In the preferred embodiment, a tapered region 32 is formed adjacent to the first long edge 27. In the tapered region 32, the thickness of the spring collar 20 decreases as it approaches the first long edge 27. As such, the first long edge 27 can be less than half as thick as the primary thickness T1 of the spring collar 20.

In use, the spring collar 20 is manually opened. The spring collar 20 is placed around the peripheral edge 33 of the aesthetic cover 16 of the recessed lighting unit 14 so that the tapered region 32 is closest to the ceiling 10. The opening of the spring collar 20 moves the spring collar 20 against its natural bias. As such, the spring collar 20 stores spring energy that acts to compress the spring collar 20 against the peripheral edge 33 of the aesthetic cover 16. The compression force increases friction between the spring collar 20 and the aesthetic cover 16. The friction is enough to support the weight of the spring collar 20. Accordingly, once the spring collar 20 is placed around an aesthetic cover 16 on a ceiling 10, it will stay in place and will not fall to the ground.

With the spring collar 20 attached to the aesthetic cover 16, the spring collar 20 extends vertically down from the ceiling 10 around the outside of the aesthetic cover 16. This protects the exterior of the aesthetic cover 16 from paint brushes, rollers or other paint applicators 35 while the ceiling 10 is being painted. Since the tapered region 32 of the spring collar 20 is closest to the ceiling 10, the spring collar 20 is thinnest at the junction where the aesthetic cover 16 meets the ceiling 10. By painting around the spring collar 20, only a very thin section of the ceiling 10 is protected by the spring collar 20 and does not receive paint. This thin section does not adversely affect the aesthetics of the newly painted ceiling 10, once this spring collar 20 is removed.

Once the ceiling 10 is fully painted, the spring collar 20 is simply pulled off the aesthetic cover 16. The spring collar 20 shielded the aesthetic cover 16 from paint, yet enabled the ceiling 10 to be painted up to the edge of the aesthetic cover 16. The only remaining gap is the gap created by the tapered first long edge 27 of the spring collar 20. This gap is minimized by the tapered region 32 along the first long edge 27 of the spring collar 20. The gap is further minimized by end tapers at the first end 24 and the second end 26 of the spring collar 20, as explained below.

Figure 4:
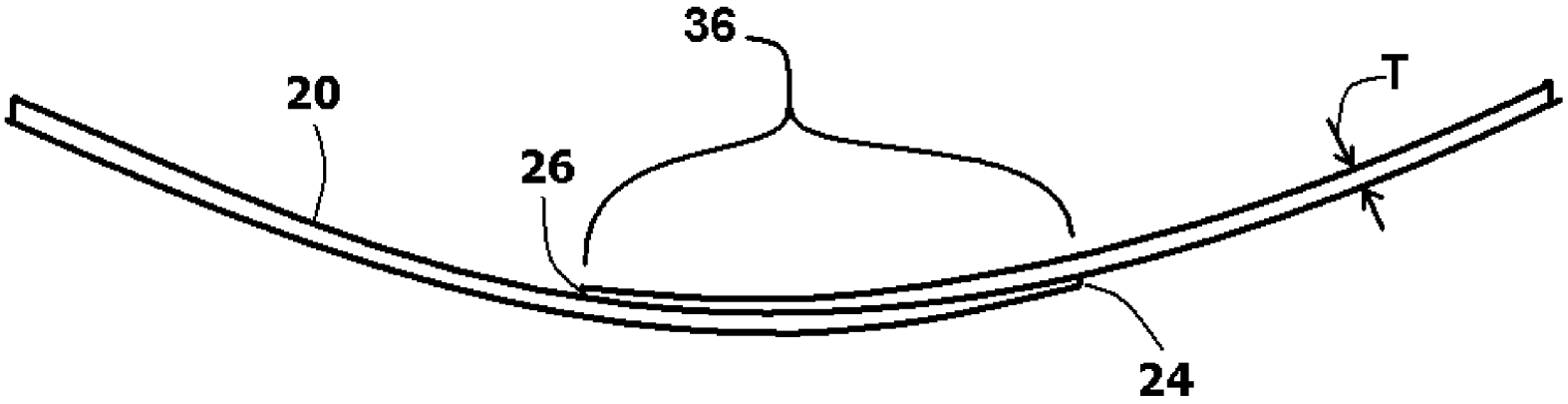
FIG. 4 shows an enlarged section of the exemplary spring collar paint shield of FIG. 1.

The spring bias of the spring collar 20 causes the first end 24 and the second end 26 of the spring collar 20 to overlap. Referring to FIG. 4 in conjunction with FIG. 1 and FIG. 2, it will be understood that the first end 24 of the spring collar 20 and the second end 26 of the spring collar 20 overlap throughput an overlap region 36. The band 22 is tapered in thickness at both ends throughout the overlap region 36. Due to the taper, when the first end 24 of the spring collar 20 and the second end 26 of the spring collar 20 overlap, their combined thickness is often no greater than the primary thickness T1 of the spring collar 20 depending upon the degree of overlap. Preferably, the combined thickness is no more than 50% thicker than the primary thickness T1. In this manner, the small unpainted ring left around the aesthetic cover 16 by the spring collar 20 is uniform and aesthetically pleasing.

Figure 5:
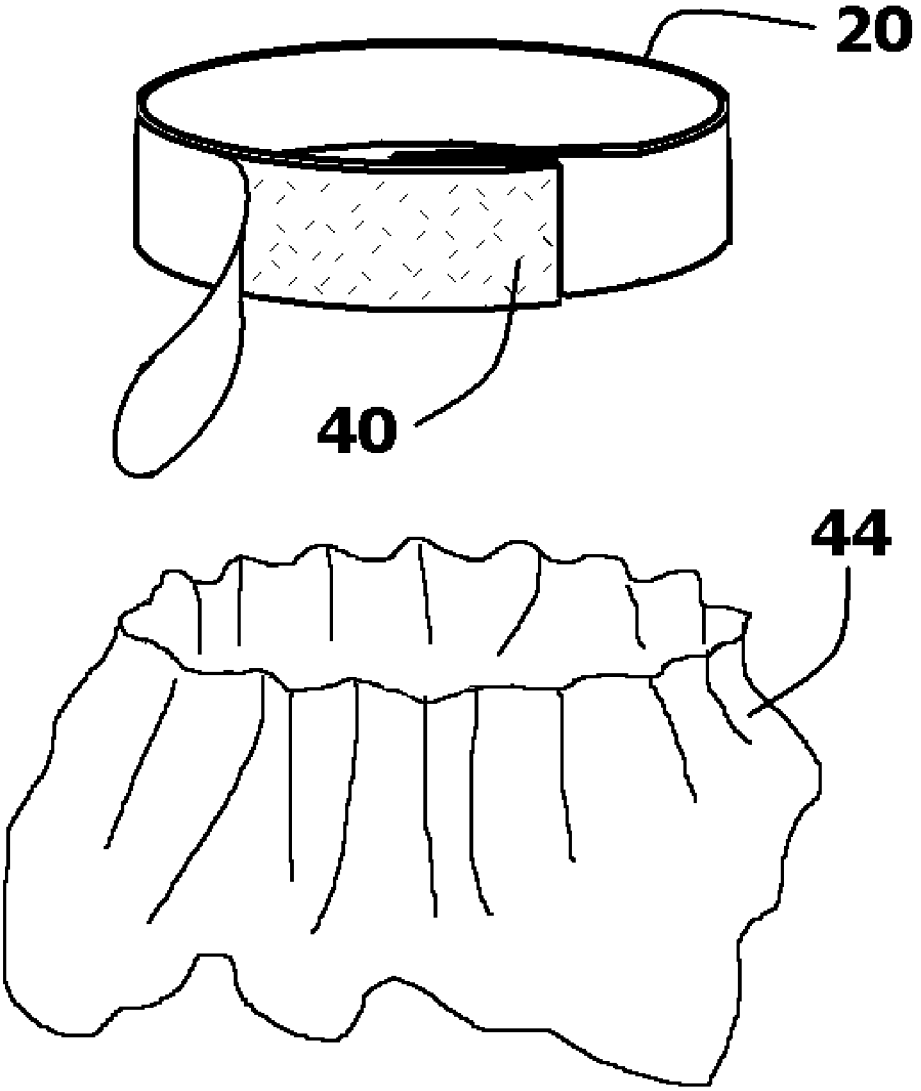
FIG. 5 shows an alternate embodiment of a paint shield with accessories.
Figure 6:
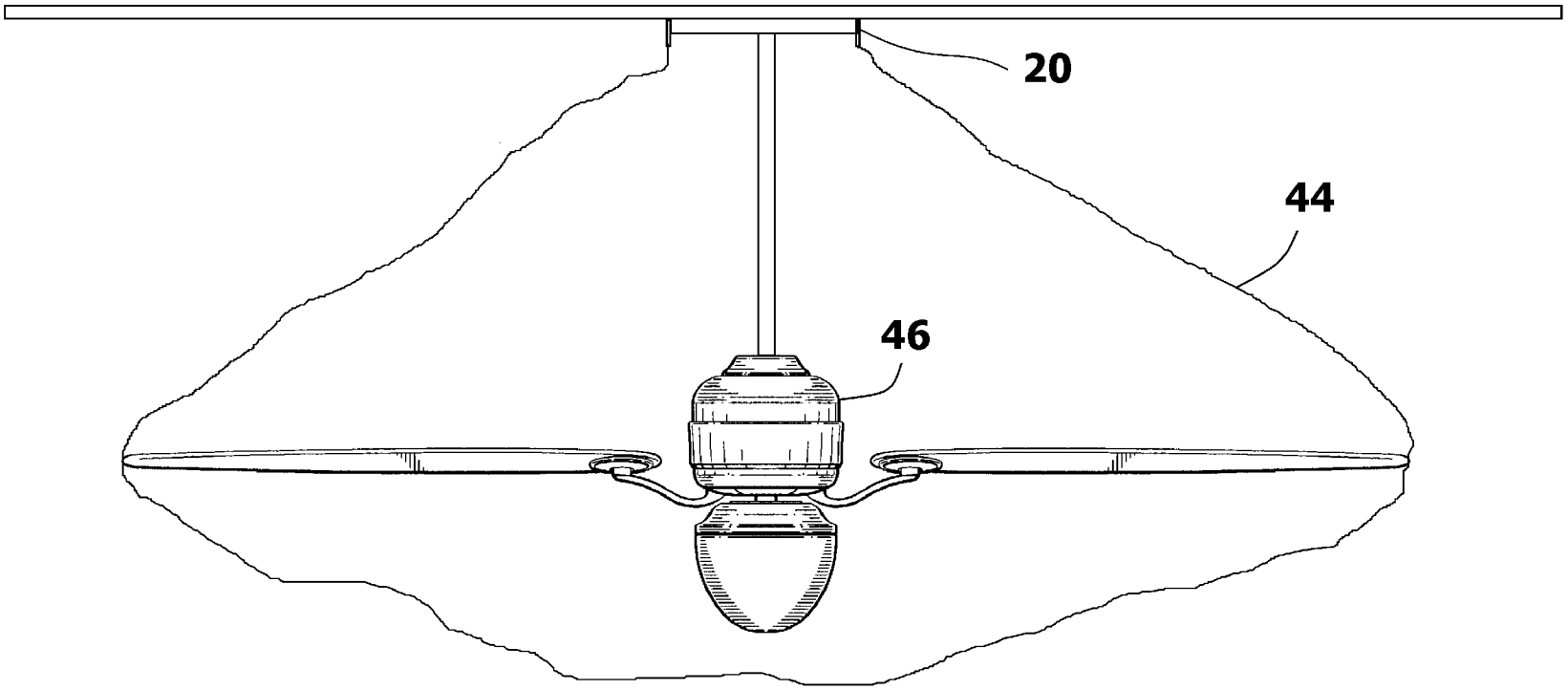
FIG. 6 shows the alternate embodiment of FIG. 5 applied to a ceiling fan.

Referring to FIG. 5 and FIG. 6, an alternate embodiment of the present invention is shown. The spring collar 20 is the same and is identified with the same reference number. In this embodiment, additional features are added to the spring collar 20. A strip of adhesive 40 is provided on the exterior of the spring collar 20. The strip of adhesive 40 is protected by a peel-away element 42. The spring collar 20 is sold with a thin gauge bag 44. The bag 44 has an expanded shape so that the bag 44 can surround a ceiling fan 46, while the mouth of the bag 44 can be compressed to a diameter that is not much larger than the spring collar 20. The bag 44 has a slotted side so that the bag 44 can be opened large enough to receive a ceiling fan 46 or hanging chandelier.

To use this embodiment, the spring collar 20 is applied to the base of a ceiling fan 46 in the same manner that it can be applied to the aesthetic cover of a recessed lighting unit. The spring collar 20 will surround and protect the base of the ceiling fan 46 from paint. The spring collar 20 stays held in place by friction.

The bag 44 is opened and placed around the ceiling fan 46. The open end of the bag 44 is gathered near the spring collar 20. The strip of adhesive 40 on the spring collar 20 is exposed and the open end of the bag 44 is attached to the spring collar 20. The bag 44 protects the ceiling fan 46 and the spring collar 20 protects the base of the ceiling fan 46.

In yet another alternate embodiment of the present invention, it should be understood that the bag 44 can be preattached to the spring collar 20. In this case, the bag 44 would be unrolled from the spring collar 20, after the spring collar 20 is installed.

Figure 7:
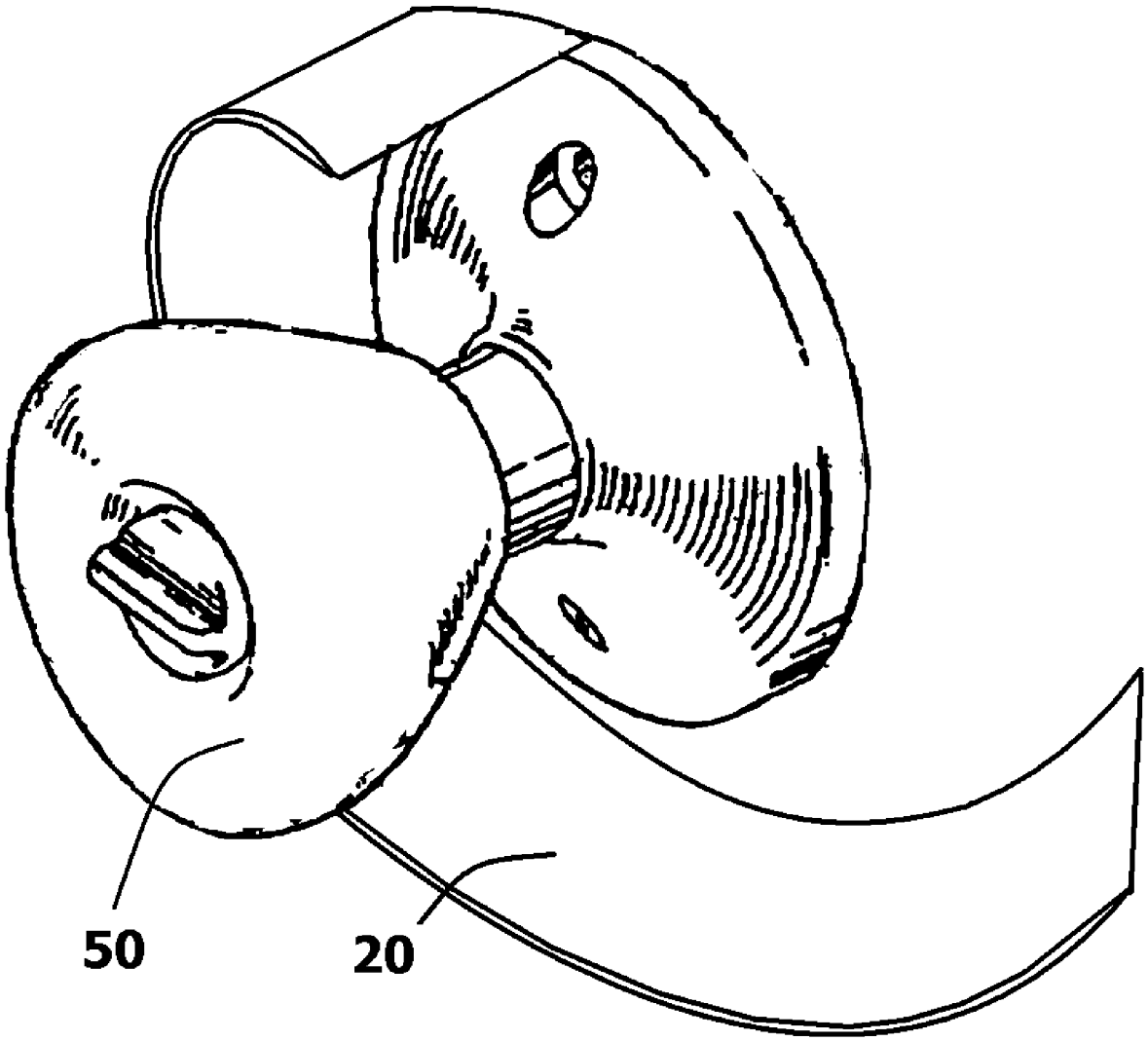
FIG. 7 shows an alternate embodiment of a paint shield applied to a door knob.

It will be understood that the spring collar 20 can also be used to protect elements on walls and doors prior to painting. The spring collar 20 can protect wall lighting fixtures, thermostats, wall switches and the like. Referring to FIG. 7, one such alternate use is illustrated. In this embodiment, the spring collar 20 is attached around the doorknob 50 of a door and protects the doorknob 50 from paint.

Figure 8:
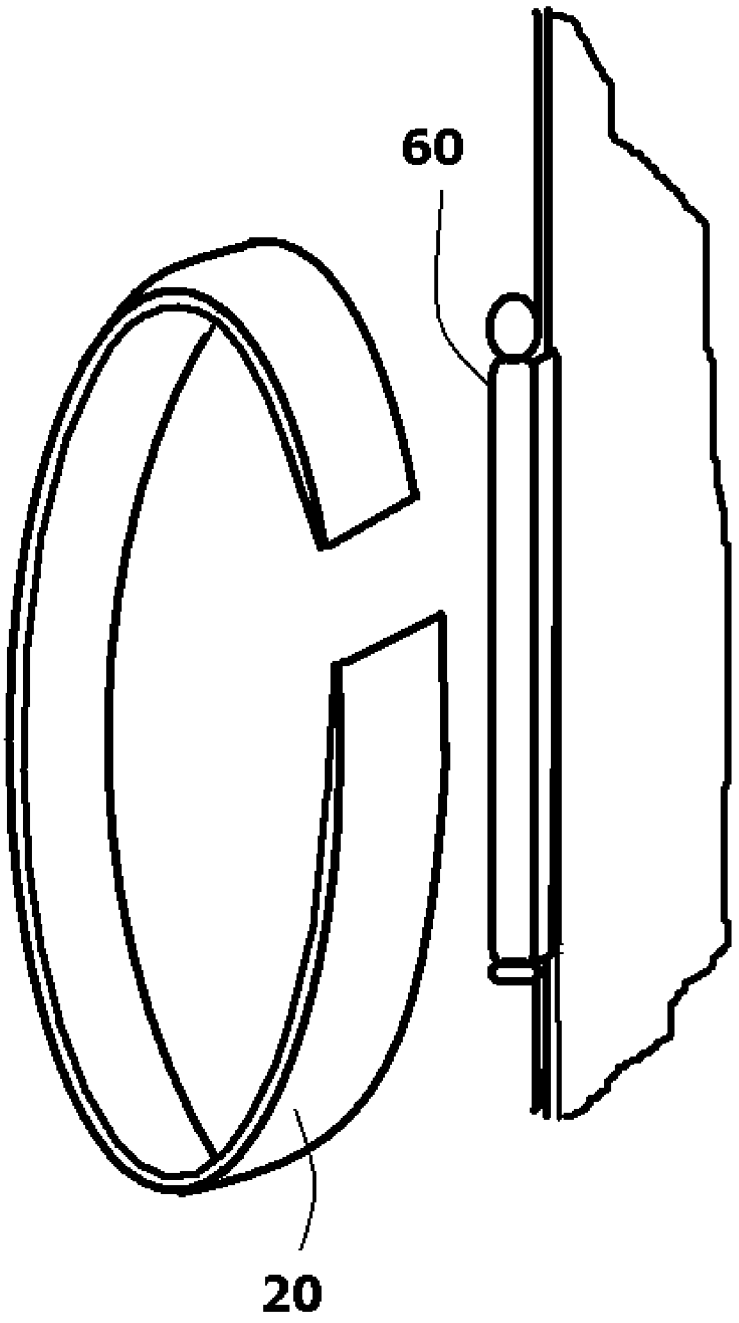
FIG. 8 shows an alternate embodiment of a paint shield applied to a door hinge.

Referring to FIG. 8, the spring collar 20 is shown applied to a non-round object, such as an exposed door hinge 60. In this way, it is better understood that the spring collar 20 can protect any object or any shape, provided the spring collar 20 can wrap around that object.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A protective collar for temporarily protecting an item on a surface from paint that is being applied, said protective collar including:

a band that extends from a first end to a second end, said band having a first edge and a second edge that extend from said first end to said second end, wherein said first edge and said second edge are parallel, said band having one concave surface that extends from said first end to said second end and one convex surface that extends from said first end to said second end, wherein said band has a maximum thickness between said convex surface and said concave surface; and a tapered region that extends along said band proximate said first edge, wherein said tapered region tapers toward said first edge causing said first edge on said tapered region to be thinner than said maximum thickness, wherein said band embodies a spring bias that biases said band into a circular configuration where said first end and said second end of said band overlap in an overlap region.

2. The protective collar according to claim 1, wherein said band has a length between ten inches and twenty-five inches.

3. The protective collar according to claim 1, wherein said maximum thickness is no greater than $1/16^{th}$ of an inch.

4. The protective collar according to claim 1, wherein said circular configuration has a diameter of between four inches and eight inches.

5. The protective collar according to claim 1, wherein said band has a width of between one inch and three inches between said first edge and said second edge.

6. The protective collar according to claim 1, wherein said band is molded from polypropylene.

7. The protective collar according to claim 1, wherein said first end and said second end of said band are tapered so that a combined thickness of said first end and said second end in said overlap region is no more than fifty percent thicker than said maximum thickness for said band.

8. The protective collar according to claim 1, wherein a protective bag is attached to said band.

9. The protective collar according to claim 8, further including an adhesive coating on said band, wherein said adhesive coating is contacted by said bag, therein joining said bag to said band.

* * * * *